US005688003A

United States Patent [19]

Beale

[11] Patent Number: 5,688,003

[45] Date of Patent: Nov. 18, 1997

[54] RETAINING LATCH FOR A WATER PIT GATE

[75] Inventor: Arden R. Beale, Idaho Falls, Id.

[73] Assignee: The United States of America as represented by the United States Department of Energy, Washington, D.C.

[21] Appl. No.: 694,576

[22] Filed: Aug. 9, 1996

[51] Int. Cl.[6] ..... E05C 3/04

[52] U.S. Cl. ..... 292/202; 292/241

[58] Field of Search ..... 292/202, 241, 292/DIG. 7, 59

[56] References Cited

U.S. PATENT DOCUMENTS

| | | | |
|---|---|---|---|
| 1,043,106 | 11/1912 | Horst | 292/202 X |
| 1,149,090 | 8/1915 | Schmidt | 292/202 X |
| 1,178,964 | 4/1916 | Stoddard | 292/241 X |
| 1,198,166 | 9/1916 | Stoddard | 292/241 X |
| 1,878,544 | 9/1932 | Schmidt | 292/202 X |
| 1,940,685 | 12/1933 | Lenfestey | 292/241 |
| 2,747,908 | 5/1956 | Bennison | 292/241 |
| 3,645,573 | 2/1972 | Strang | 292/241 |
| 3,841,675 | 10/1974 | Mercer | 292/241 |
| 4,418,951 | 12/1983 | Schultz et al. | 292/202 |
| 4,758,402 | 7/1988 | Schukei et al. | 292/241 X |

FOREIGN PATENT DOCUMENTS

| | | | |
|---|---|---|---|
| 8094 | of 1901 | United Kingdom | 292/202 |
| 453799 | 9/1936 | United Kingdom | 292/202 |
| 989693 | 4/1965 | United Kingdom | 292/202 |

*Primary Examiner*—Rodney M. Lindsey

*Attorney, Agent, or Firm*—Virginia B. Caress; William R. Moser; Paul A. Gottlieb

[57] ABSTRACT

A retaining latch for use in a hazardous materials storage or handling facility to adjustably retain a water pit gate in a gate frame. A retaining latch is provided comprising a latch plate which is rotatably mounted to each end of the top of the gate and a recessed opening, formed in the gate frame, for engaging an edge of the latch plate. The latch plate is circular in profile with one side cut away or flat, such that the latch plate is D-shaped. The remaining circular edge of the latch plate comprises steps of successively reduced thickness. The stepped edge of the latch plate fits inside a recessed opening formed in the gate frame. As the latch plate is rotated, alternate steps of the latch plate are engaged by the recessed opening. When the latch plate is rotated such that the flat portion of the latch plate faces the recessed opening in the gate frame, there is no connection between the opening and the latch plate and the gate is unlatched from the gate frame.

12 Claims, 3 Drawing Sheets

RETAINING LATCH FOR A WATER PIT GATE

BACKGROUND OF THE INVENTION

1. Field of the Invention

The present invention relates to retaining devices which are used to latch two elements or parts together and, more particularly, to gate latches for use in locking a gate to a wall bracket in a water pit utilized to store or handle hazardous materials.

2. The Prior Art

Storage facilities for hazardous materials my include a water pit which is divided into sections. Removable stainless steel gates are provided to separate adjacent sections of the water pit when draining of a particular section is desired. The gates typically have a pneumatic bladder attached to the edge of the gate and this bladder is inflated to provide a water-tight seal between the gate and the gate frame. It is important that each gate be capable of being latched in place with a retaining mechanism that will provide adequate force to retain the position of the gate against the upward force created by the bladder.

A typical water pit gate and the prior art retaining mechanism are shown in FIG. 1. A gate 10 is shown positioned within a gate frame 12 which is formed in the walls 14 of a water pit 16. A pneumatic bladder 13 is attached within the after channel of gate 10 and is inflated by compressed air provided through air line 18 such that bladder 13 forms a water-tight seal between gate 10 and gate frame As bladder 13 is inflated, it urges gate 10 upwardly out of gate frame 12. With this system, a crossbar 20 is provided at each end of gate to retain gate 10 in position within gate frame 12 and each crossbar 20 is held in place by positioning it within brackets 22 which are attached to the walls 14 on each side of gate frame 12. Bladder 13 is most effective when the gate rises only a limited amount, preferably ⅛ inch or less. To accomplish this the prior art system provides a shim or wedge 24 which is positioned between crossbar 20 and the top of gate 10 to adjust and limit the allowable rise or play in gate 10. To remove gate 10 from the water pit, bladder 13 is deflated, shim 24 is dislodged and crossbars 20 are removed from brackets 22.

While this prior art retaining system is functional, it suffers from a number of drawbacks. First, the prior art system has several loose parts which may be lost or my fall into the water pit. Second, the prior art system is difficult and time consuming to install and to remove. And third, because of the various shim sizes that are required, it is difficult to interchange gates for use in different gate frames. One other significant drawback of the prior art system is that the placement of brackets 22 interferes with a new monorail transfer system (not shown) which traverses water pit 16 adjacent to wall 14 of the water pit.

SUMMARY OF THE INVENTION

In accordance with the present invention, a retaining latch is provided which overcomes the drawbacks of the prior art system described above. The retaining latch has no loose parts and only one moving part which may readily be adjusted by a single person using a common hand-held tool, such as a wrench. Further, the retaining latch of the present invention requires no brackets or other parts to be attached to the walls of the water pit and, therefore, the mechanism does not interfere with the new monorail transfer system mentioned above. This is important to minimize loss of water should an emergency situation occur.

The retaining latch of the present invention comprises a latch plate, having an edge of varying thickness, which is rotatably mounted to the edge of a first part and a catch means formed in a second part for alternately engaging a portion of the edge of the latch plate when the latch plate is rotated. Thus, to retain a water pit gate in a gate frame, the retaining latch of the present invention provides a latch plate which is rotatably mounted to the end of the top of the gate, and a recessed opening is formed in the gate frame, adjacent to the latch plate, for engaging a portion of the edge of the latch plate.

In a preferred embodiment, the latch plate is circular in profile with one side cut away or flat, such that the latch plate is D-shaped. The remaining circular edge of the latch plate is of progressively reduced thickness. While the edge of the latch plate may gradually vary in thickness, thus forming a ramp or a cam, in a preferred embodiment, the edge varies in thickness in steps such that distinct and predetermined variations in play are obtained as the latch plate is rotated to engage the recessed opening.

Advantageously, a hex-nut is attached to the top of the latch plate to allow the latch plate to be turned by a wrench. Preferably, a central aperture or hole extends through the latch plate and the hex-nut and a belt protrudes through the central hole and attaches to the gate below in order to rotatably attach the latch plate to the gate.

While the retaining latch of the present invention has been described with relation to retaining a water pit gate in a gate frame, the latch may be used where a simple, efficient, remotely operable locking device is needed for retaining purposes.

Other objects, features, and advantages of the present invention will be set forth in, or will became apparent from, the detailed description of the preferred embodiments of the invention which follows.

DESCRIPTION OF THE PREFERRED EMBODIMENT

Figure 1:
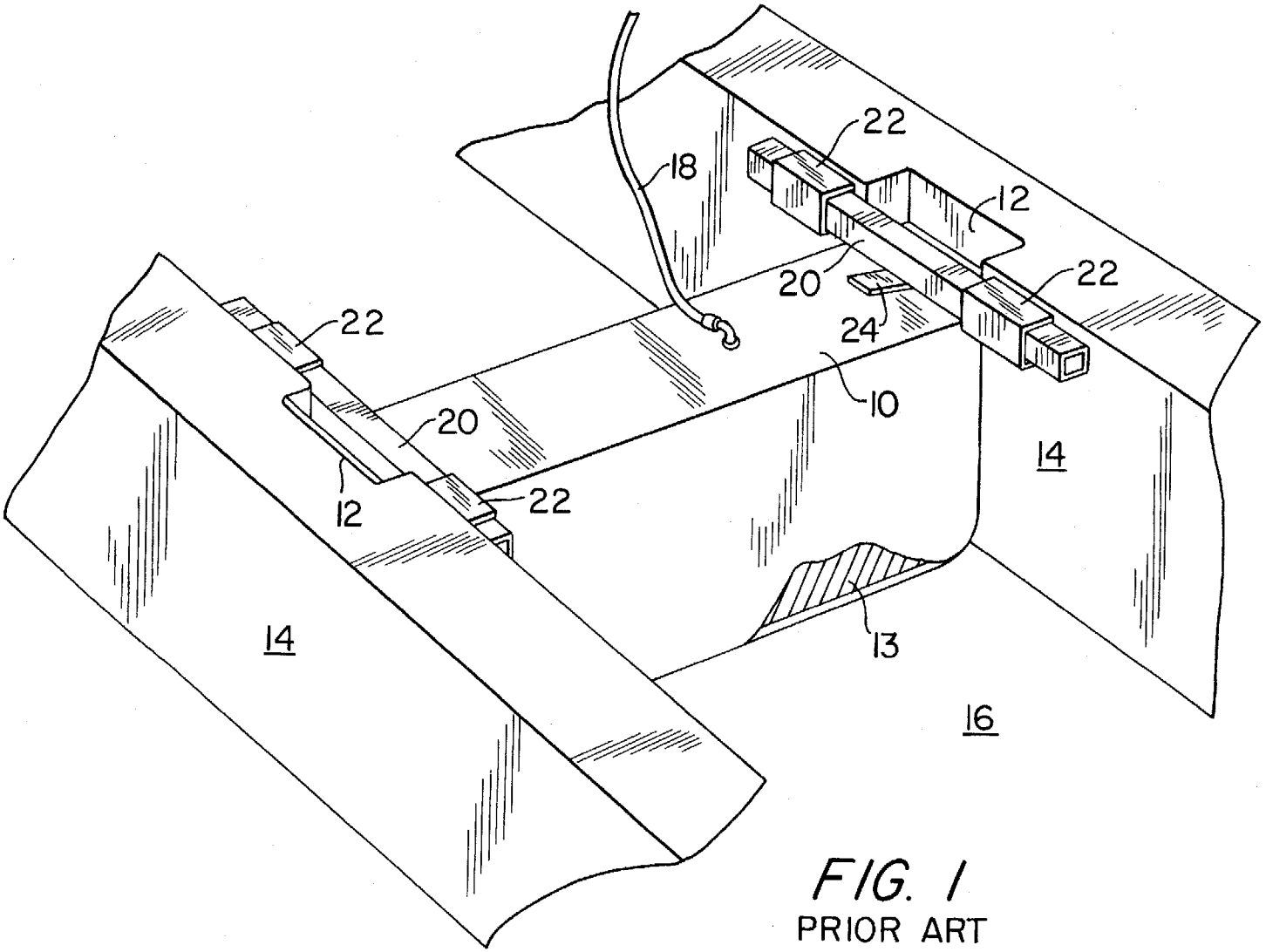
FIG. 1 PRIOR ART
FIG. 1 is, as described above, a perspective view of a prior art retaining mechanism in use on a water pit gate.
Figure 2:
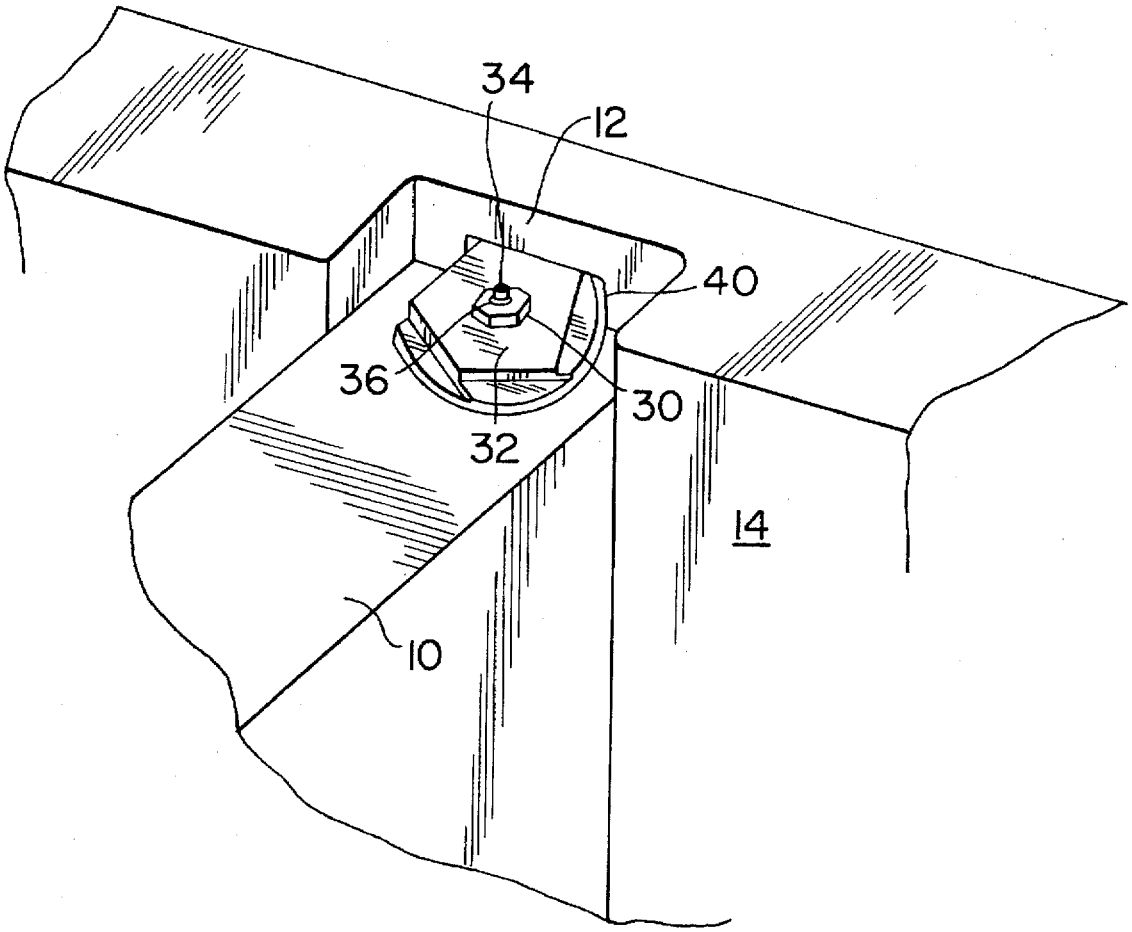
FIG. 2 is perspective view of a retaining latch constructed in accordance with a preferred embodiment of the present invention, in use on a water pit gate.
Figure 3:
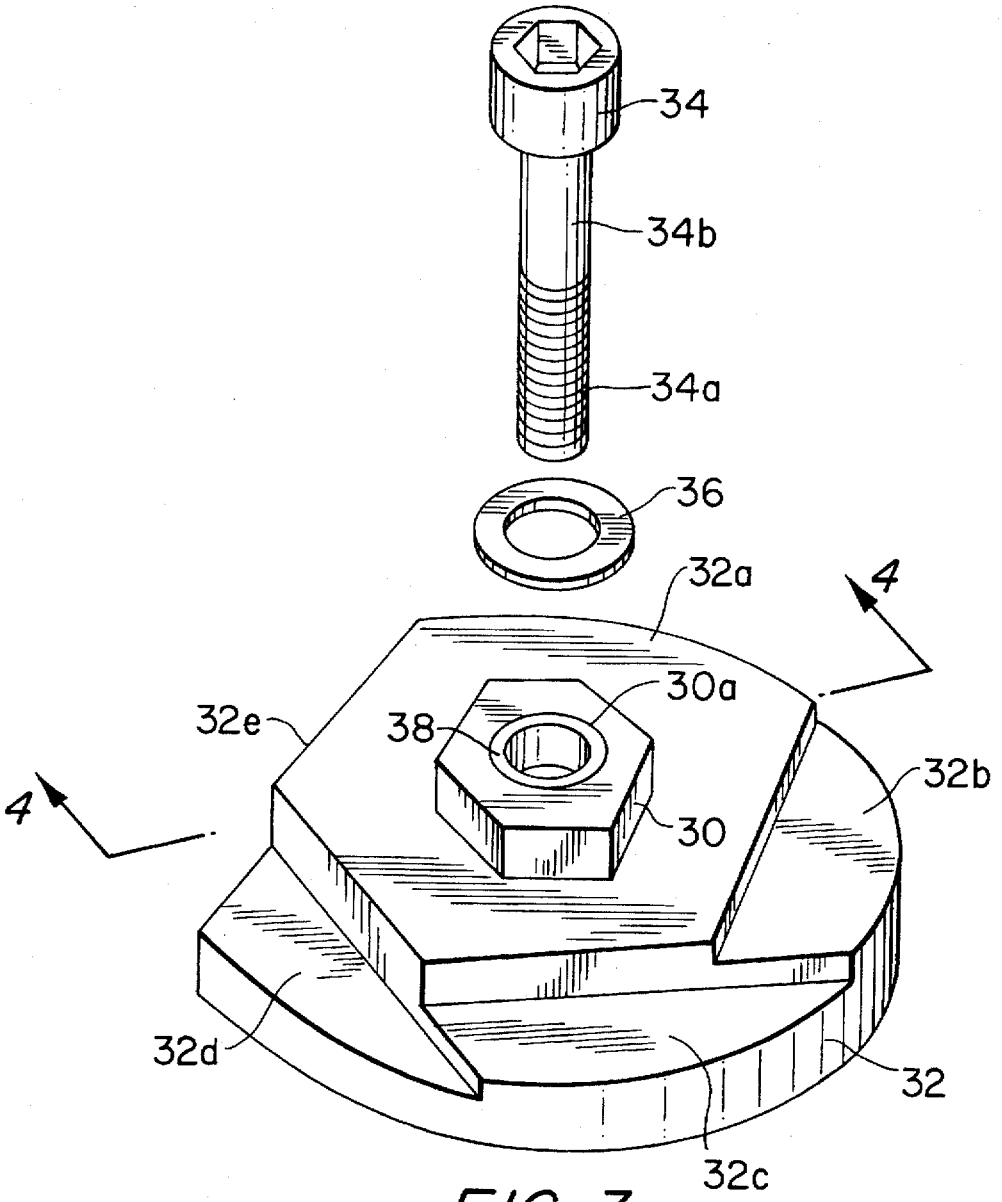
FIG. 3 is an exploded perspective view of a portion of the retaining latch shown in FIG. 2.
Figure 4:
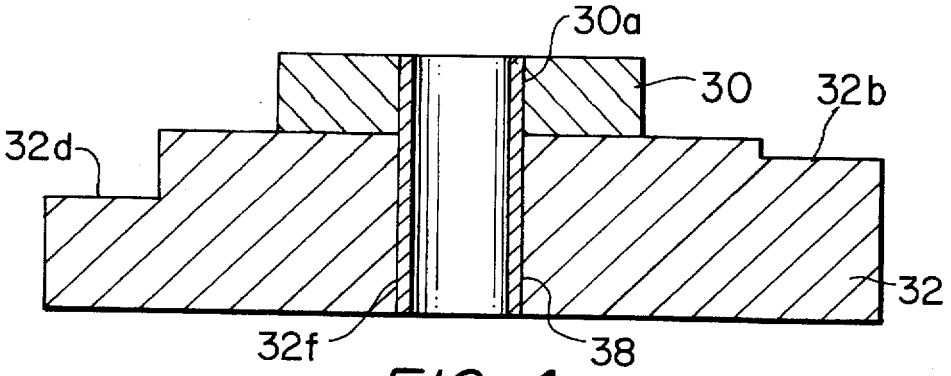
FIG. 4 is a cross-sectional view of the latch plate and hex-nut of FIG. 3 taken generally along line 4—4.

Referring to FIGS. 2 to 4 of the drawings in which like numerals represent corresponding elements throughout the several views, FIG. 2 shows a retaining latch in accordance with a preferred embodiment of the present invention in use on a gate 10 which is positioned within a gate frame 12. It will be understood that, in use, a second retaining latch (not shown) would typically be positioned on the other side of gate 10, similar to the manner in which the two retaining mechanisms are used in the prior art system shown in FIG. 1. As shown in FIG. 2, a hex-nut 30 is attached to a latch plate 32 and this assembly is rotatably attached to gate 10 with a hex-head cap bolt 34 and a thrust washer 36. In the position shown, a portion of latch plate 32 is positioned within a rectangular recessed opening 40 formed in gate frame 12.

An exploded view of latch plate 32, hex-nut 30, cap bolt 34 and thrust washer 36 is shown in FIG. 3 and, in this view it is more clearly shown that latch plate 32 is D-shaped in profile, that is, latch plate 32 is generally circular but with one side of the profile flat or cut away. The upper surface of latch plate 32 is divided into four sections, a first section 32*a* is the full thickness of latch plate 32 and the remaining three sections, 32*b*, 32*c*, and 32*d* are of progressively reduced thicknesses. The flat side of latch plate 32 (the side that appears to be cut away) is referenced as side 32*e*. Although FIG. 3 is not to scale, in the embodiment shown, latch plate 32 is ten inches in diameter and one inch thick at section 32*a*, ⅞ inch thick at section 32*b*, ¾ inch thick at section 32*c*, and ⅝ inch thick at section 32*d*.

An aperture or hole 32*f* (shown in FIG. 4) is located through the center of latch plate 32. Hex-nut 30, which has center aperture or hole 30*a* having no internal threads, is welded to latch plate 32 such that center hole 30*a* aligns with hole 32*f*. Alternatively, attachment of hex-nut 30 to latch plate 32 may be made by any number of other suitable methods including screws, pins, welding and the like or made from one piece. Advantageously, a bushing 38 is inserted into center holes 30*a* and 32*f* to provide a more durable wear surface during use. A cap bolt 34, having a lower threaded portion 34*a* and an upper shoulder portion 34*b* is positioned through thrust washer 36 such that shoulder portion 34*b* projects through bushing 38 and threaded portion 34*a* screws into the top of gate 10.

Referring again to FIG. 2, in use, latch plate 32 is rotated, using a wrench on hex-nut 30, such that a particular section of latch plate 32 is positioned within recessed opening 40 of gate frame 12 so that no more than ⅛ inch of play exists between gate 10 and gate frame 12 when the bladder is deflated. In the view shown, section 32*a* of latch plate 32 is positioned within recessed opening 40; however, with particular gates and gate frames, only a thinner section of latch plate 32, e.g. section 32*b*, 32*c* or 32*d*, may fit within opening 40. To unlatch the retaining latch, latch plate 32 is rotated such that the flat side 32*e* faces opening 40, thereby effecting no camection or latching between opening 40 and latch plate 32.

In the preferred enbodiment of the present invention described above, latch plate 32 rests directly on the top of gate 10. Advantageously, to allow greater adjustment in the height of the stepped sections 32*a*–32*d* of latch plate 32, shims may be positioned between latch plate 32 and the top of gate 10, thus raising the height of latch plate 32 with respect to recessed opening 40. Further, bushing 38 may be threaded to allow height adjustment of latch plate 32. These two features make it possible to adjust the latches on individual gates to fit in various gate frames.

Although the invention has been described in detail with respect to preferred embodiments thereof, it will be apparent to those skilled in the art that variations and modifications can be effected in these embodiments without departing from the spirit and scope of the invention.

I claim:

1. A retaining latch for retaining a water pit gate in a gate frame, said latch comprising:

latch plate having a first edge portion consisting of a first thickness and second, third, and fourth edge portions consisting of second, third, and forth different thicknesses;

an attachment means for rotatably attaching said latch plate to one edge of the gate so as to selectively provide rotation of said latch plate to a first position wherein said first edge portion would protrude beyond said edge of the gate and to a second, third or fourth position wherein said second, third, or fourth edge portion would protrude beyond said edge of the gate; and a catch means, for location on said gate frame, for engaging said edge portions when said latch plate is in said positions so as to enable different amounts of limited relative movement between the gate and the gate frame depending on whether said latch plate is in said first, second, third or fourth positions.

2. A retaining latch as in claim 1, wherein said latch plate includes a further edge portion of reduced radial length relative to said first, second, third and fourth edge portions such that said further edge portion would be located inwardly of said edge of the gate when said latch plate is rotated to a further position wherein said further edge portion is in alignment with said catch means so that said further edge portion is not engaged by said catch means in said further position.

3. A retaining latch as in claim 2, wherein said latch plate is D-shaped in profile, having a flat portion and a circular portion, said further edge portion comprising said flat portion, said first edge portion comprising a first section of said circular portion and said second, third and fourth edge portions comprising second, third and fourth sections of said circular portions.

4. A retaining latch as in claim 3, wherein said first, second, third and fourth sections of said circular portion comprise stepped sections of different thicknesses.

5. A retaining latch as in claim 4, wherein said stepped sections are of successively increased thickness.

6. A retaining latch as in claim 1, wherein said catch means comprises a recessed opening for location in said gate frame.

7. A retaining latch as in claim 1, further comprising a hex-nut attached to said latch plate for allowing said latch plate to be rotated with a wrench.

8. A retaining latch as in claim 1, wherein said latch plate has an aperture therethrough.

9. A retaining latch as in claim 8, wherein said attachment means comprises a bolt which protrudes through said aperture in said latch plate for connecting to the gate.

10. A retaining latch as in claim 8, further comprising a hex-nut attached to said latch plate for allowing said latch plate to be rotated with a wrench.

11. A retaining latch as in claim 10, wherein said hex-nut has a central aperture therethrough, and said retaining latch further comprises a bushing positioned within said central aperture in said hex-nut and said aperture in said latch plate.

12. A retaining latch, a water pit gate and a gate frame,the latch for retaining said water pit gate in said gate frame, said latch comprising:

a latch plate having a first edge portion consisting of a first thickness and second, third, and fourth edge portion consisting of second, third, and forth different thicknesses;

an attachment means for rotatably attaching said latch plate to one edge of the gate so as to selectively provide rotation of said latch plate to a first position wherein said first edge portion protrudes beyond said edge of the gate to engage said gate frame and to second, third, and fourth positions wherein said second, third and fourth edge portions protrude beyond said edge of the gate to engage said gate frame; and wherein said latch plate is adapted to engage a catch means, located on said gate frame, so as to enable different amounts of limited relative movement between the gate and the gate frame depending on whether said latch plate is in said first, second, third or fourth positions.

* * * * *